US011952781B2

(12) United States Patent
Levin

(10) Patent No.: US 11,952,781 B2
(45) Date of Patent: Apr. 9, 2024

(54) WATERCRAFT CANOPY EXTENSION FOR EXISTING COVERED DOCK

(71) Applicant: Designer Direct, Inc., Des Plaines, IL (US)

(72) Inventor: Kerry Ira Levin, Des Plaines, IL (US)

(73) Assignee: Designer Direct, Inc., Des Plaines, IL (US)

( * ) Notice: Subject to any disclaimer, the term of this patent is extended or adjusted under 35 U.S.C. 154(b) by 65 days.

(21) Appl. No.: 17/586,547

(22) Filed: Jan. 27, 2022

(65) Prior Publication Data

US 2023/0235564 A1 Jul. 27, 2023

(51) Int. Cl.
*E04F 10/02* (2006.01)

(52) U.S. Cl.
CPC ..... *E04F 10/02* (2013.01)

(58) Field of Classification Search
CPC ..... E04F 10/10; E04F 10/02; E04H 14/04; E04H 15/54; E06B 7/086
See application file for complete search history.

(56) References Cited

U.S. PATENT DOCUMENTS

| | | | |
|---|---|---|---|
| 302,535 | A | 7/1884 | Holabird |
| 344,103 | A | 6/1886 | Harden |
| 394,262 | A | 12/1888 | Gentzen |
| 413,730 | A | 10/1889 | Palmer |
| 498,583 | A | 5/1893 | Smawley |
| 628,393 | A | 10/1894 | Binn |
| 1,051,252 | A | 1/1913 | Parker |
| 1,158,356 | A | 10/1915 | Wilson |
| 1,388,478 | A | 8/1921 | Nelson |
| 1,448,821 | A | 3/1923 | Andrews |
| 1,527,908 | A | 2/1925 | Noble |
| 1,538,926 | A | 5/1925 | Cass |
| 1,593,431 | A | 7/1926 | Buie |

(Continued)

FOREIGN PATENT DOCUMENTS

| | | | |
|---|---|---|---|
| CA | 1289436 | C | 9/1991 |
| CA | 2088948 | A | 8/1994 |

(Continued)

OTHER PUBLICATIONS

Pier-port 4, Youtube Video, https://www.youtube.com/watch?v=ZFcdmitfB1Q, Dec. 26, 2014 (Includes dated web page print followed by page of still images summarizing video).

(Continued)

*Primary Examiner* — Beth A Stephan
(74) *Attorney, Agent, or Firm* — stevefs atty@law; Steven Fisher-Stawinski

(57) ABSTRACT

A structure includes a vertical support, a horizontal inner rail affixed thereto, a bracket affixed to the vertical support vertically lower than the inner rail, and a cantilever support affixed slidably-lockably to the bracket, wherein the cantilever support is affixed to the bracket in a manner that is either pivotable vertically and horizontally or fixed substantially perpendicular to the inner rail. A central rail substantially aligned with the inner rail is positioned distally from the inner rail and affixed to the cantilever support. An arch member is disposed perpendicular to the rails and is affixed to the inner rail and central rail.

16 Claims, 14 Drawing Sheets

(56) References Cited

U.S. PATENT DOCUMENTS 1,625,016 A 4/1927 Barker
1,672,388 A 6/1928 McWilliam
1,953,514 A 4/1934 Rutcher
2,182,283 A 12/1939 Curtis
2,425,079 A 8/1947 Billig
2,708,346 A 5/1955 Smith
2,845,078 A 7/1958 Singleton
2,912,703 A 11/1959 Murphy
2,930,387 A 3/1960 Streich
3,003,507 A 10/1961 Ferris
3,023,732 A 3/1962 Everett
3,030,973 A 4/1962 Janda
3,083,540 A 4/1963 Smith
3,151,595 A * 10/1964 Stainbrook ..... E02B 3/24 114/230.25
3,242,620 A 3/1966 Kaiser
3,307,514 A 3/1967 Young
3,410,036 A 11/1968 Franz
3,425,428 A 2/1969 Schwarz
3,441,037 A 4/1969 Transeau
3,869,836 A 3/1975 Allen
4,312,157 A 1/1982 Hertel
4,363,284 A 12/1982 Monroe
4,683,901 A 8/1987 Mitchell
4,825,890 A 5/1989 Castlebury
4,890,599 A 1/1990 Eiden
4,898,198 A 2/1990 Castlebury
5,086,799 A 2/1992 Lumbleau
5,152,109 A 10/1992 Boers
5,185,972 A 2/1993 Markiewicz
5,314,377 A 5/1994 Pelosi
5,331,917 A 7/1994 Magers
5,419,273 A 5/1995 Cutler
5,425,327 A 6/1995 Zirkelbach
5,445,487 A * 8/1995 Koscinski, Jr. ..... B66C 23/166 212/232
D363,790 S 10/1995 Boyd
5,482,069 A * 1/1996 Lee ..... A45B 23/00 135/33.7
5,520,139 A 5/1996 King
5,573,026 A 11/1996 Griffith
5,575,301 A 11/1996 Bolton
5,601,103 A * 2/1997 Dubinsky ..... A45B 25/22 135/33.7
5,632,290 A 5/1997 Kuo
5,678,586 A * 10/1997 Baksh ..... A45B 25/22 135/33.7
5,697,320 A 12/1997 Murray
5,709,501 A 1/1998 Elbers
5,775,353 A 7/1998 Johnson
D403,081 S 12/1998 Luzzardi
5,904,114 A 5/1999 Wright
D412,993 S 8/1999 Chipman
5,967,162 A 10/1999 Bolton
5,979,125 A 11/1999 Guillet
D420,812 S 2/2000 Chipman
6,032,433 A 3/2000 Hatziathanasiou
6,073,587 A 6/2000 Hill
6,155,278 A * 12/2000 Lin ..... A45B 25/18 135/33.7
6,202,662 B1 * 3/2001 Lin ..... A45B 25/22 135/33.7
6,237,616 B1 * 5/2001 You ..... A45B 25/22 135/33.7
6,250,319 B1 * 6/2001 You ..... A45B 25/22 135/33.7
6,360,492 B1 3/2002 Ross
D468,837 S 1/2003 Shilling
6,505,638 B1 1/2003 Powell
6,536,992 B1 3/2003 Floe
6,615,550 B2 9/2003 Reuschel
6,688,252 B1 2/2004 Caravella
6,691,723 B2 2/2004 Godberson
6,976,806 B2 12/2005 Edson
7,001,104 B2 2/2006 Edson
7,055,538 B2 6/2006 Deng
D530,022 S 10/2006 Haymann
7,389,785 B2 6/2008 Loudermilk
7,392,816 B2 7/2008 Porter
7,401,569 B2 7/2008 Jones
7,448,399 B2 * 11/2008 Song ..... A45B 25/20 135/33.7
D584,420 S 1/2009 Gibson
7,484,518 B2 * 2/2009 Brader ..... A45B 23/00 135/31
7,527,014 B2 5/2009 Hey
D595,865 S 7/2009 Magnusson
7,555,994 B1 7/2009 Arnall
7,669,542 B2 3/2010 Donahue
7,802,340 B2 * 9/2010 Knopow ..... B25G 1/06 15/229.8
7,814,723 B2 10/2010 VanElverdinghe
7,913,710 B2 3/2011 Bougioukos
D643,937 S 8/2011 Boesch
8,286,651 B1 10/2012 Maffett
8,387,318 B2 3/2013 Kaufman
8,469,044 B1 * 6/2013 Patel ..... A45B 25/18 135/33.7
8,555,910 B2 10/2013 Webster
8,667,908 B2 3/2014 Martin
8,783,276 B2 7/2014 Skrzynski
8,789,549 B1 7/2014 Barnes
8,854,794 B2 10/2014 Van Straten
8,857,366 B2 10/2014 Russikoff
8,944,399 B2 2/2015 Sutherland
9,153,718 B2 10/2015 Richardson
9,216,798 B2 12/2015 Kent
9,272,754 B1 3/2016 Craig
9,345,941 B1 * 5/2016 Celedon ..... A63B 67/10
9,404,281 B1 8/2016 Donnay
9,556,640 B2 * 1/2017 Levin ..... E04B 1/3416
9,776,687 B2 10/2017 Levin
9,777,504 B2 10/2017 Levin
9,926,720 B2 3/2018 Huang
10,145,073 B2 12/2018 Levin
10,151,120 B1 12/2018 Kaneshiro
10,272,971 B2 * 4/2019 Levin ..... E04H 15/06
10,309,096 B2 6/2019 Levin
10,363,994 B2 7/2019 Levin
10,541,640 B2 1/2020 Levin
10,724,196 B2 7/2020 Levin
10,807,678 B2 10/2020 Levin
10,903,781 B2 1/2021 Levin
10,947,735 B2 3/2021 Auer
2003/0056818 A1 3/2003 Connelly
2003/0062074 A1 4/2003 Kuo
2003/0084934 A1 5/2003 Goldwitz
2003/0131539 A1 7/2003 Burford
2003/0183275 A1 10/2003 Yang
2003/0188775 A1 10/2003 Connelly
2004/0211452 A1 * 10/2004 Wu ..... A45B 25/22 135/33.7
2004/0226594 A1 11/2004 Connelly
2005/0016438 A1 1/2005 Hey
2005/0161071 A1 7/2005 Tseng
2005/0252542 A1 11/2005 Basta
2005/0259545 A1 11/2005 Yun
2005/0262777 A1 12/2005 Dalo
2007/0068634 A1 3/2007 Unrast
2007/0295379 A1 12/2007 Basta
2007/0295384 A1 12/2007 Uozumi
2008/0168938 A1 8/2008 Impey
2008/0236377 A1 * 10/2008 Wall ..... F41A 35/00 89/1.14
2010/0051078 A1 3/2010 Sy-Facunda
2010/0122718 A1 5/2010 Lah
2011/0290292 A1 12/2011 Kaiser
2014/0026804 A1 1/2014 Templeton
2014/0331569 A1 11/2014 Speam
2015/0000725 A1 1/2015 Reilly
2015/0308143 A1 10/2015 Levin
2016/0289989 A1 10/2016 Creagh
2016/0129975 A1 11/2016 Craig

(56) References Cited

U.S. PATENT DOCUMENTS

| | | | | |
|---|---|---|---|---|
| 2016/0368571 | A1 | 12/2016 | Levin | |
| 2017/0096834 | A1 | 4/2017 | Levin | |
| 2017/0254038 | A1 | 9/2017 | Levin | |
| 2017/0284081 | A1 | 10/2017 | Craig | |
| 2017/0349242 | A1 | 12/2017 | Levin | |
| 2017/0350156 | A1 | 12/2017 | Levin | |
| 2018/0111663 | A1 | 4/2018 | Levin | |
| 2019/0011079 | A1 | 1/2019 | Levin | |
| 2019/0013768 | A1 | 1/2019 | Levin | |
| 2019/0063024 | A1 | 3/2019 | Levin | |
| 2019/0144076 | A1 | 5/2019 | Levin | |
| 2023/0184376 | A1* | 6/2023 | Witherbee ..... | F16M 13/022 248/125.1 |

FOREIGN PATENT DOCUMENTS

| | | | |
|---|---|---|---|
| CA | 2916336 | | 10/2016 |
| CA | 2933478 | | 12/2016 |
| CA | 2959902 | | 9/2017 |
| CA | 3010646 | | 1/2019 |
| CA | 3023443 | | 5/2019 |
| CA | 3024239 | | 5/2019 |
| CN | 204112218 | U | 1/2015 |
| CN | 111021305 | A | 4/2020 |
| DE | 102006019755 | A1 | 10/2007 |
| EP | 3147428 | A1 | 3/2017 |
| FR | 1520912 | A | 4/1968 |
| FR | 2142243 | A5 | 1/1973 |
| FR | 2169482 | A5 | 9/1973 |
| WO | 2011140557 | A1 | 11/2011 |
| WO | 2011157969 | A1 | 12/2011 |

OTHER PUBLICATIONS

Pier-port 6, Youtube Video, https://www.youtube.com/watch?v=p4oxEgZDreQ, Apr. 6, 2015 (Includes dated web page print followed by page of still images summarizing video).

Pier-port 6, Youtube Video, https://www.youtube.com/watch?v=-KR4u5i6ego, Apr. 7, 2015 (Includes dated web page print followed by page of still images summarizing video).

Pier-Port|Cantilevered Boat Canopy, Pier-port.com, The Internet Wayback Machine, Apr. 7, 2015, https://web.archive.org/web/20150407033100/http://pier-port.com/ (Prints and screenshots of dated snapshot).

"Pier Port Canopy", Google Plus Photo Album, https://get.google.com/u/0/albumarchive/110920703178663712557/album/AF1QipNE1WevACOPKOBohs3ZbF67jas087WWCg-mdfpl (19 Photographs dated between May 31, 2014 and Feb. 15, 2015).

"Pier-Port", Pier-port.com, Internet Archive Wayback Machine, Jan. 16, 2021, https://web.archive.org/web/20210116020220/https://www.pier-port.com/.

"Pier-Port", Pier-port.com, Internet Archive Wayback Machine, Apr. 22, 2021, https://web.archive.org/web/20210422225128/https://pier-port.com/ (Grace Period Disclosure).

"Boat Shelters", Pier-port.com, Internet Archive Wayback Machine, Apr. 22, 2021, https://web.archive.org/web/20210422223655/https://pier-port.com/boat-shelters/ (Grace Period Disclosure).

"Hemi-Port", Pier-port.com, Internet Archive Wayback Machine, Apr. 19, 2021, https://web.archive.org/web/20210422225128/https://pier-port.com/ (Grace Period Disclosure).

"Hemi-Port Lite", Pier-port.com, Internet Archive Wayback Machine, Apr. 22, 2021, https://web.archive.org/web/20210422224529/https://pier-port.com/product/hemi-port-lite/ (Grace Period Disclosure).

"Hemi-Port XL", Pier-port.com, Internet Archive Wayback Machine, Apr. 22, 2021, https://web.archive.org/web/20210422235350/https://pier-port.com/product/hemi-port-xl/ (Grace Period Disclosure).

"Screenshots of Various Pages at Pier-port.com", Jan. 22, 2022, https://pier-port.com/ (Grace Period Disclosure).

* cited by examiner

WATERCRAFT CANOPY EXTENSION FOR EXISTING COVERED DOCK

BACKGROUND OF THE INVENTION

The invention relates generally to canopy structures and in particular to a retrofit canopy for attachment to an existing watercraft boathouse and/or covered mooring area.

Various structures are known in the art of structures for covering watercraft. In particular, permanent boathouses or covered docks are known wherein one or more marine docks are enclosed with a roof and, optionally, walls, at a fixed width and position relative to the dock. In some installations, watercraft users and/or marine dock users would benefit from an extensible, lightweight canopy extension retrofit that adds area coverage and weather protection to an existing covered dock, boathouse, or similar structure without extensive or irreversible modification to such a structure.

SUMMARY OF THE INVENTION

In an embodiment, a structure includes at least one substantially vertical support, an inner rail substantially aligned in a first horizontal dimension affixed to the at least one vertical support and defining a second horizontal dimension perpendicular to the first horizontal dimension, at least one bracket affixed to the at least one vertical support vertically lower than the inner rail and aligned in a substantially vertical plane, and at least one cantilever support affixed slidably-lockably to the at least one bracket. The at least one cantilever support is affixed to said bracket in a manner selected from the group consisting of: (a) a first manner such that the cantilever support is substantially aligned in the second horizontal dimension, and (b) a second manner such that the cantilever support is pivotable vertically and pivotable in a horizontal angle with respect the second horizontal dimension that is greater than zero degrees and less than ninety degrees. The structure further includes a central rail substantially aligned in the first horizontal dimension substantially parallel to the inner rail, positioned distally from the inner rail in the second horizontal dimension, and affixed to the at least one cantilever support. The structure further includes at least one arch member substantially aligned in the second horizontal dimension and affixed to the inner rail and said central rail.

In an embodiment, the structure further includes an outer rail substantially aligned in the first horizontal dimension substantially parallel to the inner rail and the central rail, positioned distally from said central rail in the second horizontal dimension, and affixed to the at least one cantilever support.

In an embodiment, the at least one vertical support is preexistingly affixed, at its vertical bottom end, to a substantially horizontal platform and preexistingly affixed, at its vertical top end, to a roof.

In an embodiment, the structure further includes a canopy cover stretched over said at least one arch member.

In an embodiment, a structure includes a canopy frame supporting a canopy cover affixed thereto. The canopy cover includes a seam oriented substantially horizontally. The seam includes a canopy cover upper sheet overhanging a canopy cover lower sheet. The seam includes at least one stitched region wherein the canopy cover lower part is stitched to the canopy cover upper part and at least one unstitched region wherein the canopy cover lower part hangs freely.

In an embodiment, the canopy cover lower part is overfolded upward in the at least one stitched region so as to create an outwardly concave catchment in the at least one unstitched region.

In an embodiment, a structure includes a bracket member, a transverse member affixed to the bracket member transverse to a first longitudinal axis of the bracket member, and a receptacle element affixed to the transverse member. At least one of the transverse member and the receptacle member element is rotatable-lockable about a second longitudinal axis of the transverse member. The receptacle element includes a pivot receptacle configured to pivotably-lockably receive an inserted member.

BRIEF DESCRIPTION OF THE DRAWINGS

The accompanying drawings are included to provide a further understanding of the invention and are incorporated into and constitute a part of the specification. They each illustrate one embodiment of the invention and, together with the description, serve to explain the principles of the invention.

DETAILED DESCRIPTION OF THE INVENTION

Figure 1:
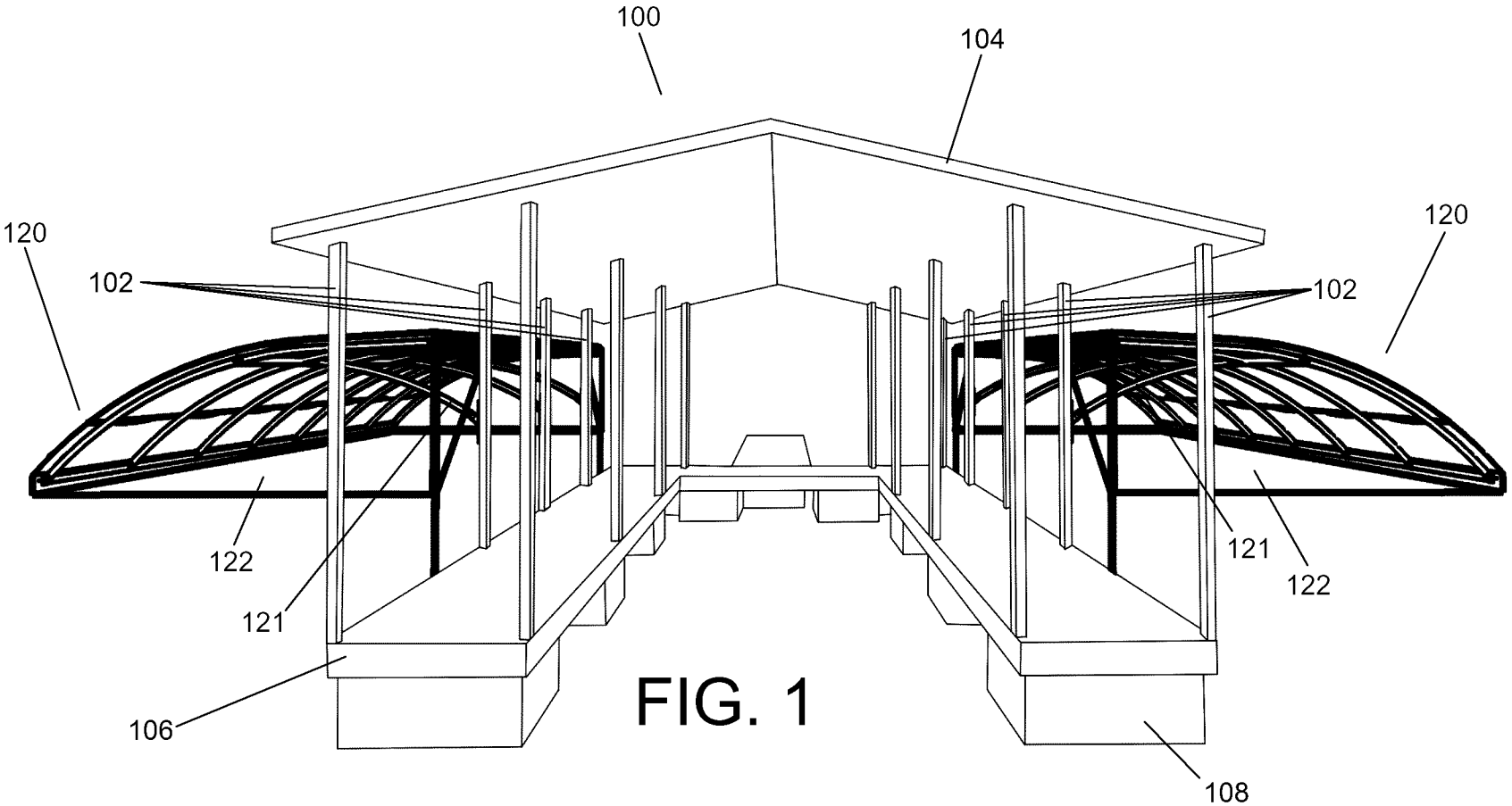
FIG. 1 is a side profile view of an embodiment, exemplary of a single cantilever member per bracket, of the invention installed on a U-shaped watercraft dock with a pre-existing roof covering, as viewed from the water, and with a transparent canopy cover installed on the invention.

Referring now to the invention in more detail, the invention is directed to a watercraft canopy extension system that is contemplated principally (but not necessarily) for retrofit to an existing boat house or covered dock structure with preexisting vertical supports. FIG. 1 is exemplary of such an embodiment, with a covered U-shaped dock 100 including outer vertical supports 102 (e.g. posts, columns) that extend from at least a roof 104 to a deck 106.

In the depicted embodiment, the covered U-shaped dock 100 is supported in the water by floats 108 and may thus be understood as a floating dock. However, in other embodiments, the dock may be fixed to augur poles, built up from the water body bed, cantilevered from shore, or supported by an underwater trundle system, or any other of the various known or subsequently discovered means of supporting a marine dock.

In at least one embodiment, the covered U-shaped dock 100 is preexisting such that it is not possible to pass a closed loop of material around any of the outer vertical supports 102 without breaking or detaching the outer vertical support 102 from either the deck 106 pr the roof 104, or else by assembling such a loop of material around the outer vertical support 102.

While the embodiment of FIG. 1 contemplates a preexisting marine dock and a retrofit for it, it should be noted that the invention may similarly be practiced with a purpose-built covered dock, or with other type of structure that has vertical supports to which the apparatus of the invention may be mounted, as described in further detail below. Embodiments of the invention may be adapted to extend the overhead cover of a gazebo, porch, or other structure including vertical supports and/or walls, but which is not adjacent to water, whether or not such structure is preexisting or purpose-built for use with the invention. Further, embodiments of the invention may be affixed to one or more bare poles affixed vertically to extend above or hang below some substrate.

Referring still to the embodiment depicted in FIG. 1, a canopy frame 120, which may be understood as a half barrel vault shape, is affixed to at least one of the outer vertical supports 102. As used herein, a "half barrel vault" need not conform exactly to one quarter of a circle of arc when viewed in cross section, but instead may follow any curve (e.g., but not necessarily, an unreflexed or uninflected curve, as shown) generally from horizontal where mounted on the outer vertical supports 102 to downward-trending at its outer edge (i.e. a tangent line extended from the end of the canopy is angled below horizontal so as to eventually intercept the water level). Further, the embodiment of FIG. 1 depicts a canopy cover 122 stretched over the canopy frame 120.

Figure 2:
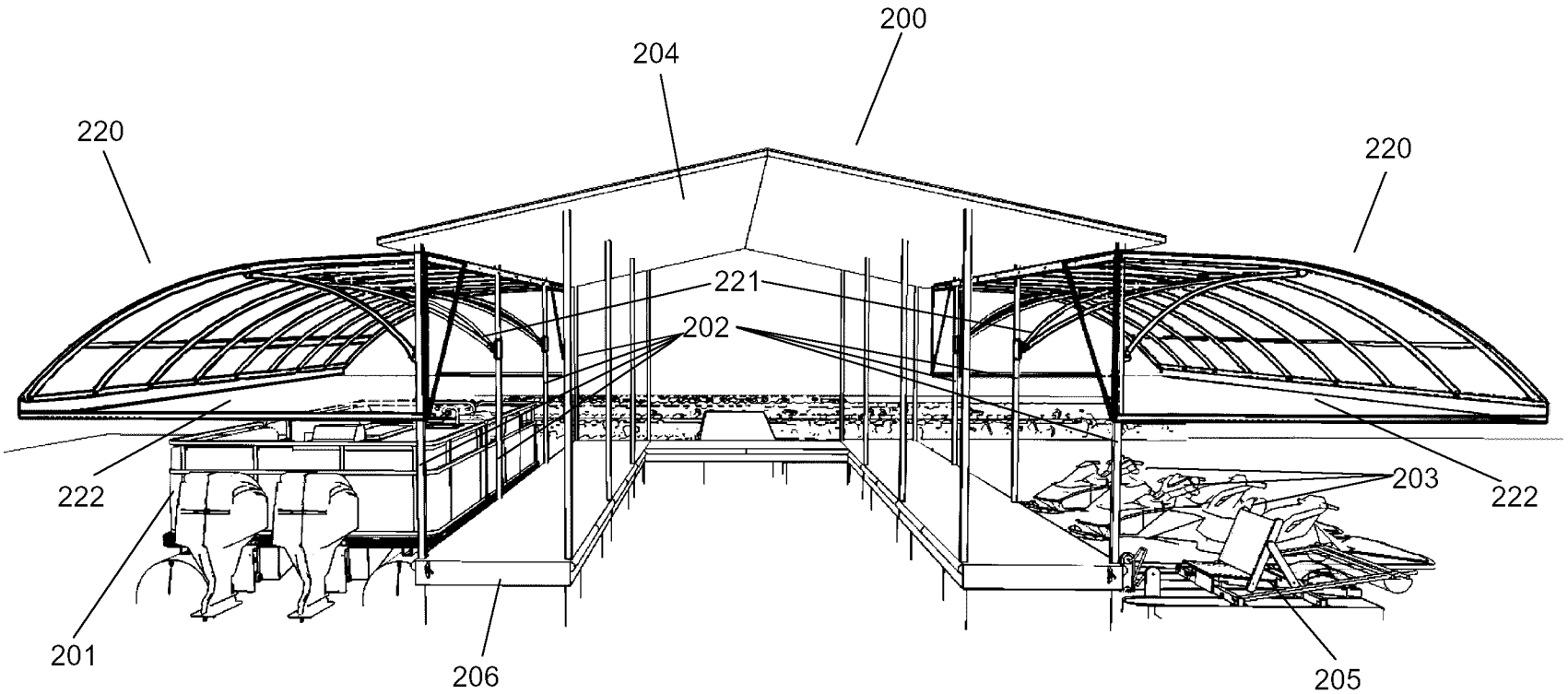
FIG. 2 is a side profile view of an embodiment, exemplary of two cantilever members per bracket, of the invention installed on a U-shaped watercraft dock with a pre-existing roof covering, as viewed from the water, with exemplary watercraft parked thereat, and with a transparent canopy cover installed on the invention.

At least two variants of the canopy frame 120 are presented herein. In the embodiment of FIG. 1, several cantilever supports 121 extend out from the preexisting vertical supports 102, about perpendicular to the deck 106. The second such variant is shown in the embodiment of FIG. 2. Referring now to FIG. 2, the depicted embodiment includes a covered U-shaped dock 200 including outer vertical supports 202 that extend from at least a roof 204 to a deck 206, all with an exemplary canopy frame 220 affixed thereto, as shown, as well as a canopy cover 222 stretched thereover. Exemplary watercraft are depicted in FIG. 2 parked in one possible relation to the apparatus of the invention: a pontoon boat 201, a pair of personal watercraft 203, and a paddle boat 205. By contrast to the first variant, as in the embodiment of FIG. 1, in the embodiment depicted in FIG. 2, two cantilever members 221 are affixed a single one of the outer vertical supports 202 at an angle less than perpendicular to the dock 206 and greater than parallel to it. Thus, embodiments of the second variant include a degree of axial loading along the dimension of the dock, from the canopy frame 220 to the outer vertical supports 202. Further contemplated is a hybrid variant wherein both single and double attachment styles of the cantilever support 121 or 221 to the outer vertical supports 102 or 202 are present in the same installation.

Figure 3:
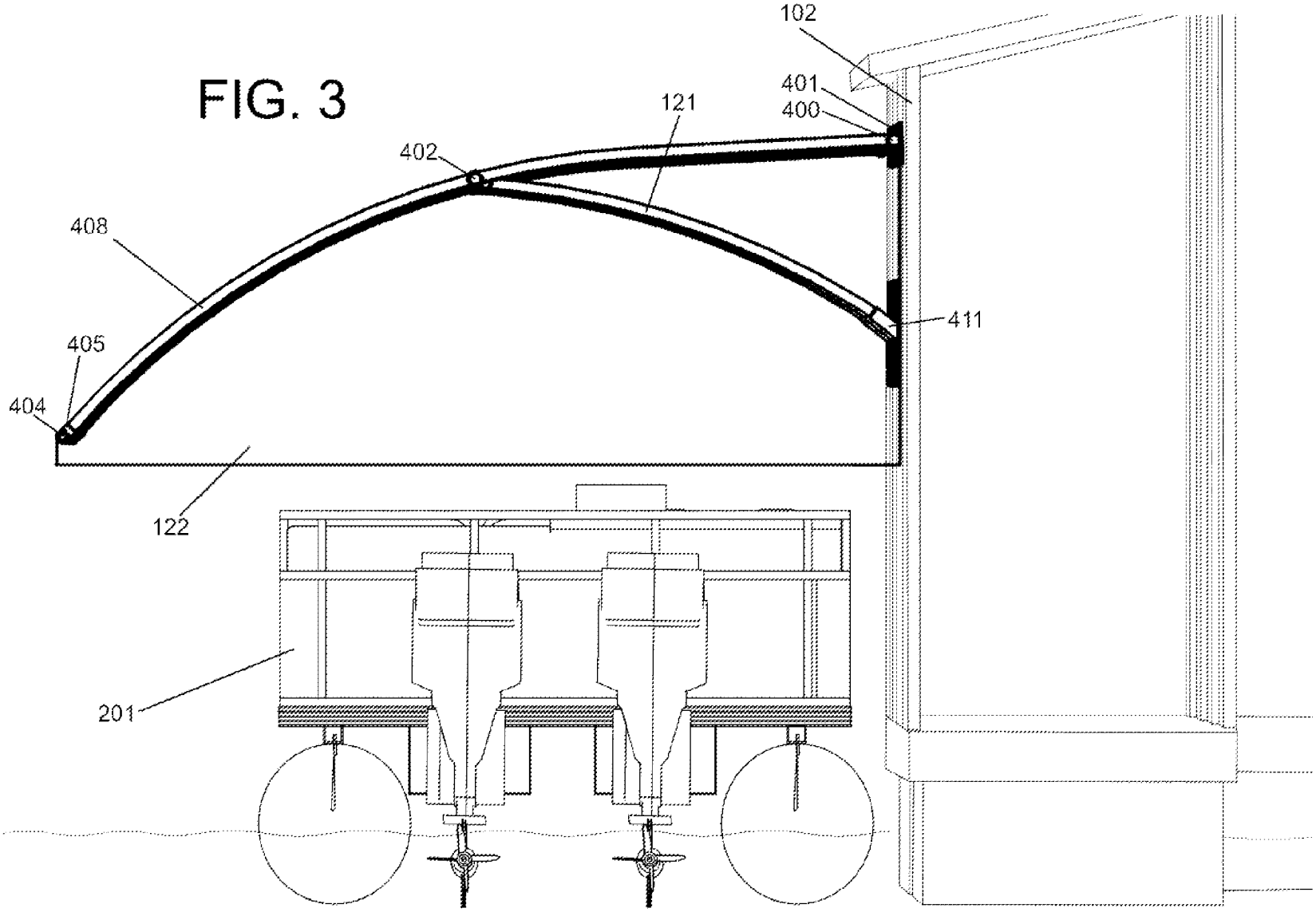
FIG. 3 is a side profile view of an embodiment, exemplary of a single cantilever member per bracket, of the invention installed on one side of a watercraft dock with a pre-existing roof covering, as viewed from the water with an exemplary watercraft parked thereat, and with a schematic representation of a canopy cover shown as if installed on the invention.
Figure 4:
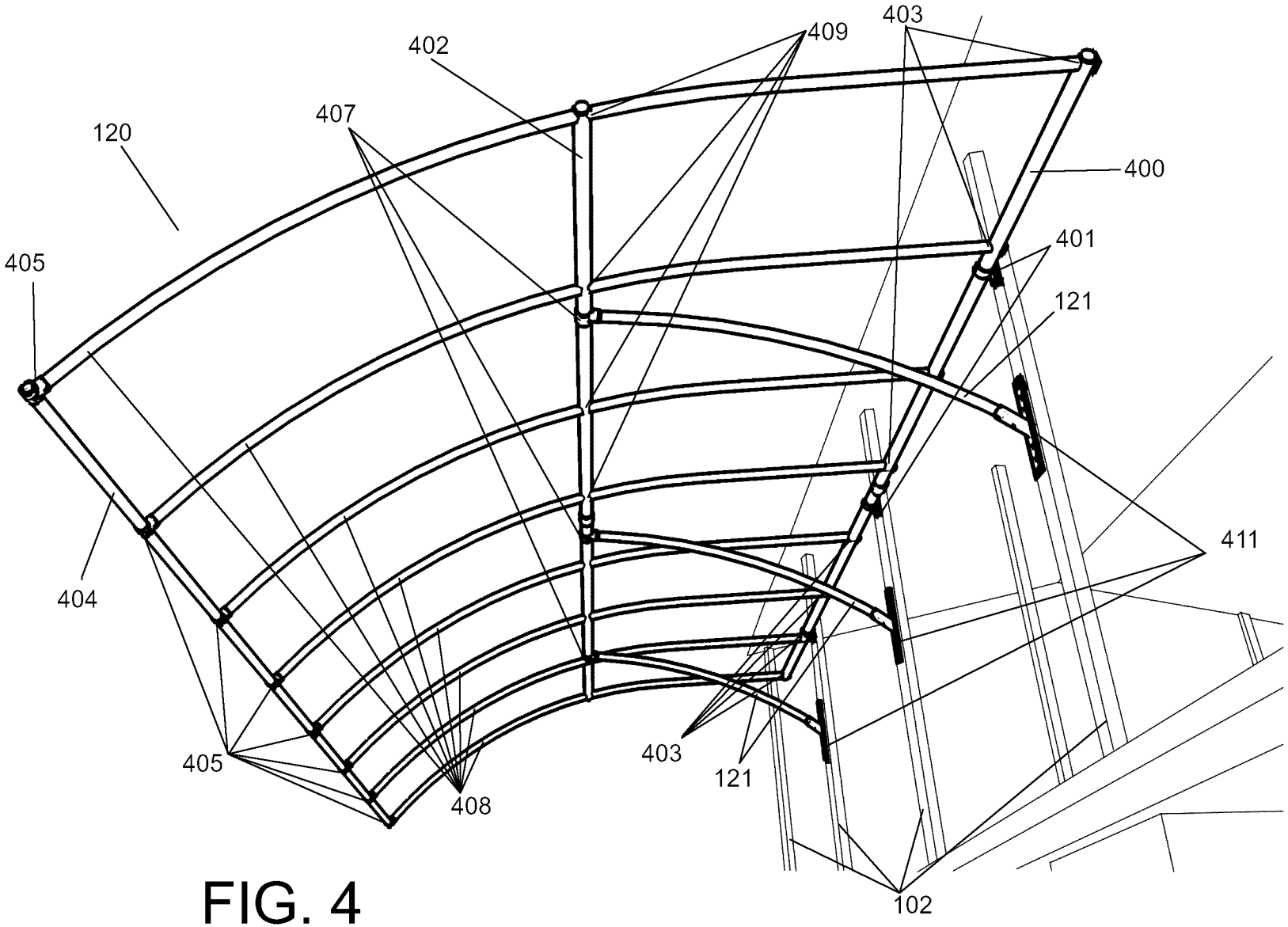
FIG. 4 is a lowered perspective view of an embodiment, exemplary of a single cantilever member per bracket, of the invention installed on one side of a watercraft dock with a pre-existing roof covering, as viewed from the water, and without a canopy cover installed on the invention.
Figure 5:
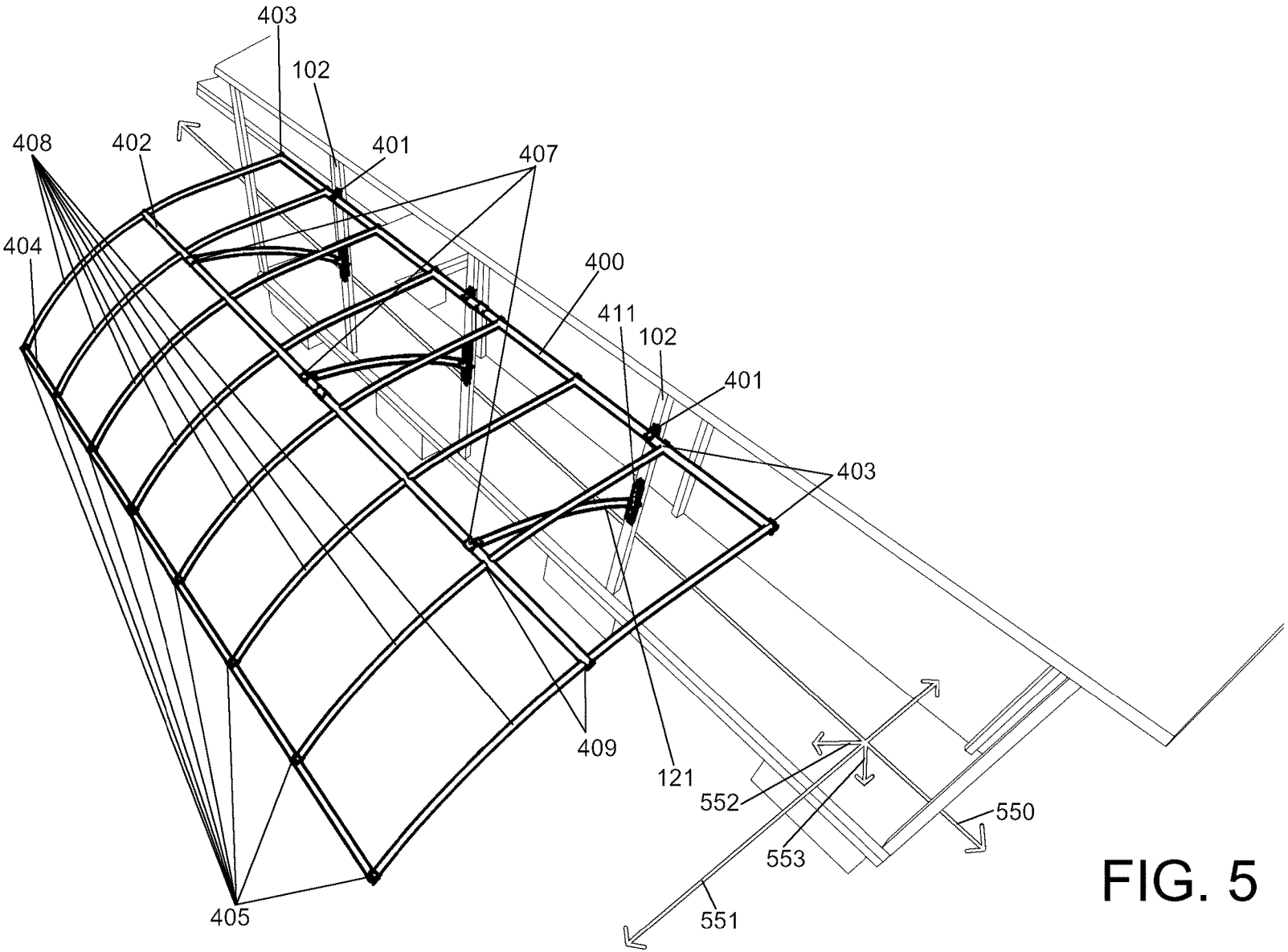
FIG. 5 is an elevated left perspective view of an embodiment, exemplary of a single cantilever member per bracket, of the invention installed on one side of a watercraft dock with a pre-existing roof covering, as viewed from the water, and without a canopy cover installed on the invention.

Referring now to an exemplary embodiment of the first (single cantilever support) variant depicted in FIGS. 3-5, an inner rail 400 is affixed horizontally across several of the outer vertical supports 102 via the inner rail brackets 401. Several arch members 408 are affixed at an inner end to the inner rail 400 at the inner arch joints 403. Centrally to the arch members 408 is affixed, via the central arch joints 409, a central rail 402, which is substantially horizontal and substantially parallel to the inner rail 400. At the distal terminus of the several arch members 408 is affixed, via the outer arch fittings 405, an outer rail 404. The cantilever supports 121 are affixed to the vertical cantilever brackets 411, which are affixed to the outer vertical supports 102, generally vertically lower than the inner rail brackets 401. Distally, the cantilever supports 121 are affixed to the central rail 402 to which they are affixed via the distal cantilever fittings 407, which, in the depicted embodiment, form a rotatable and/or rotatable-lockable joint about the central rail 402.

Figure 6:
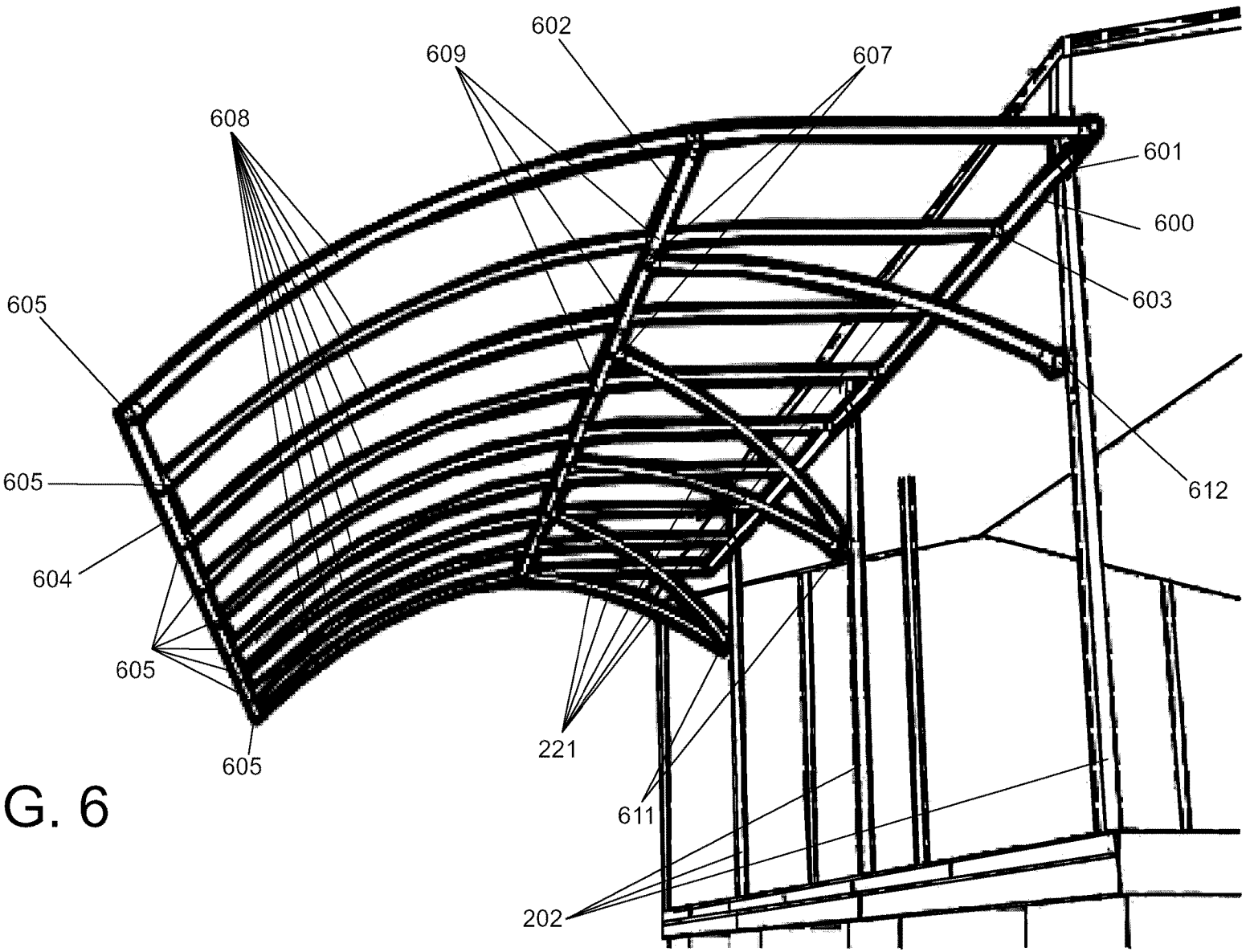
FIG. 6 is a lowered left perspective view of an embodiment, exemplary of two cantilever members per bracket, of the invention installed on one side of a watercraft dock with a pre-existing roof covering, as viewed from the water, and without a canopy cover installed on the invention.
Figure 7:
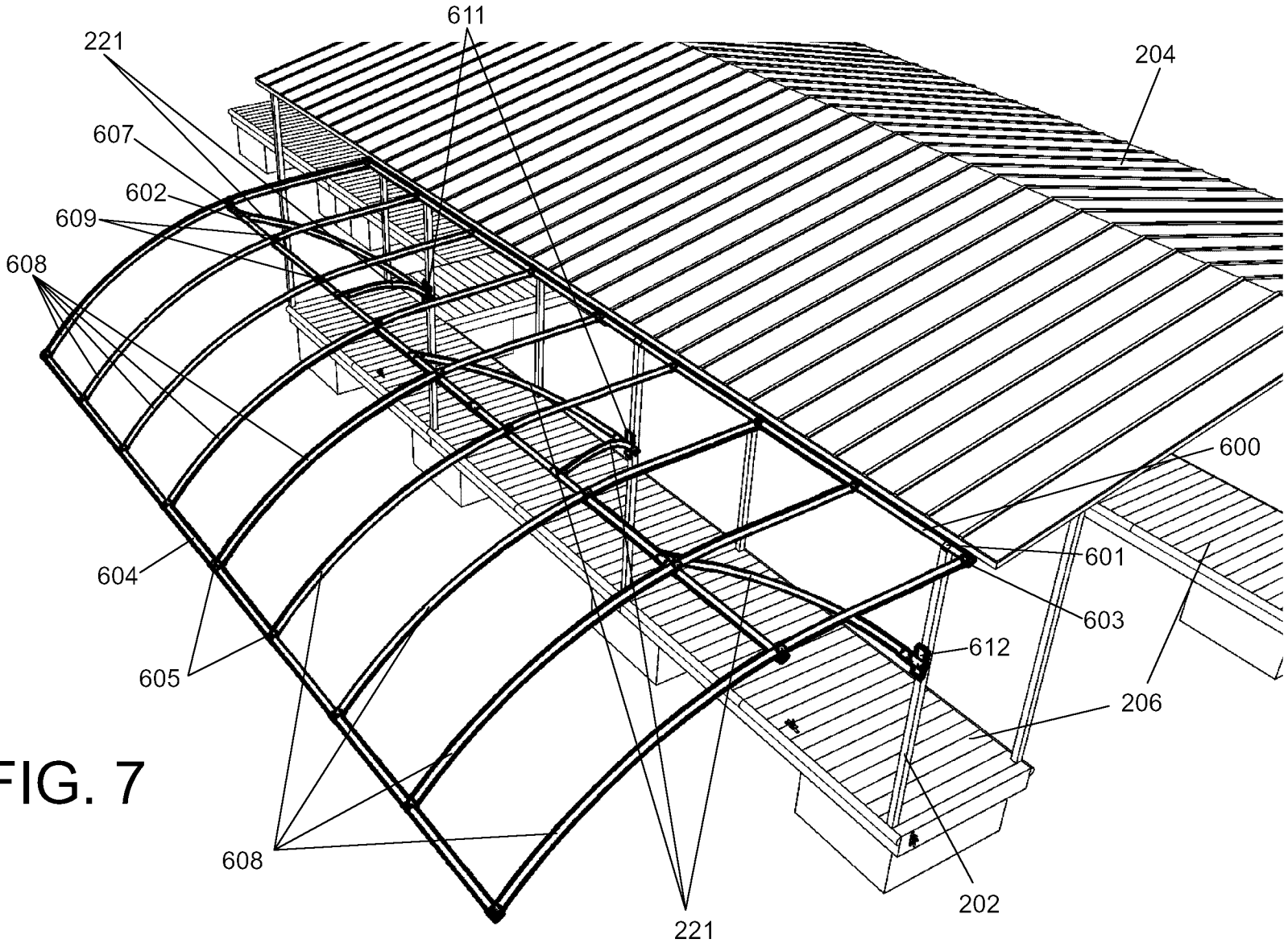
FIG. 7 is an elevated left perspective view of an embodiment, exemplary of a single cantilever member per bracket, of the invention installed on one side of a watercraft dock with a pre-existing roof covering, as viewed from the water, and without a canopy cover installed on the invention.
Figure 8:
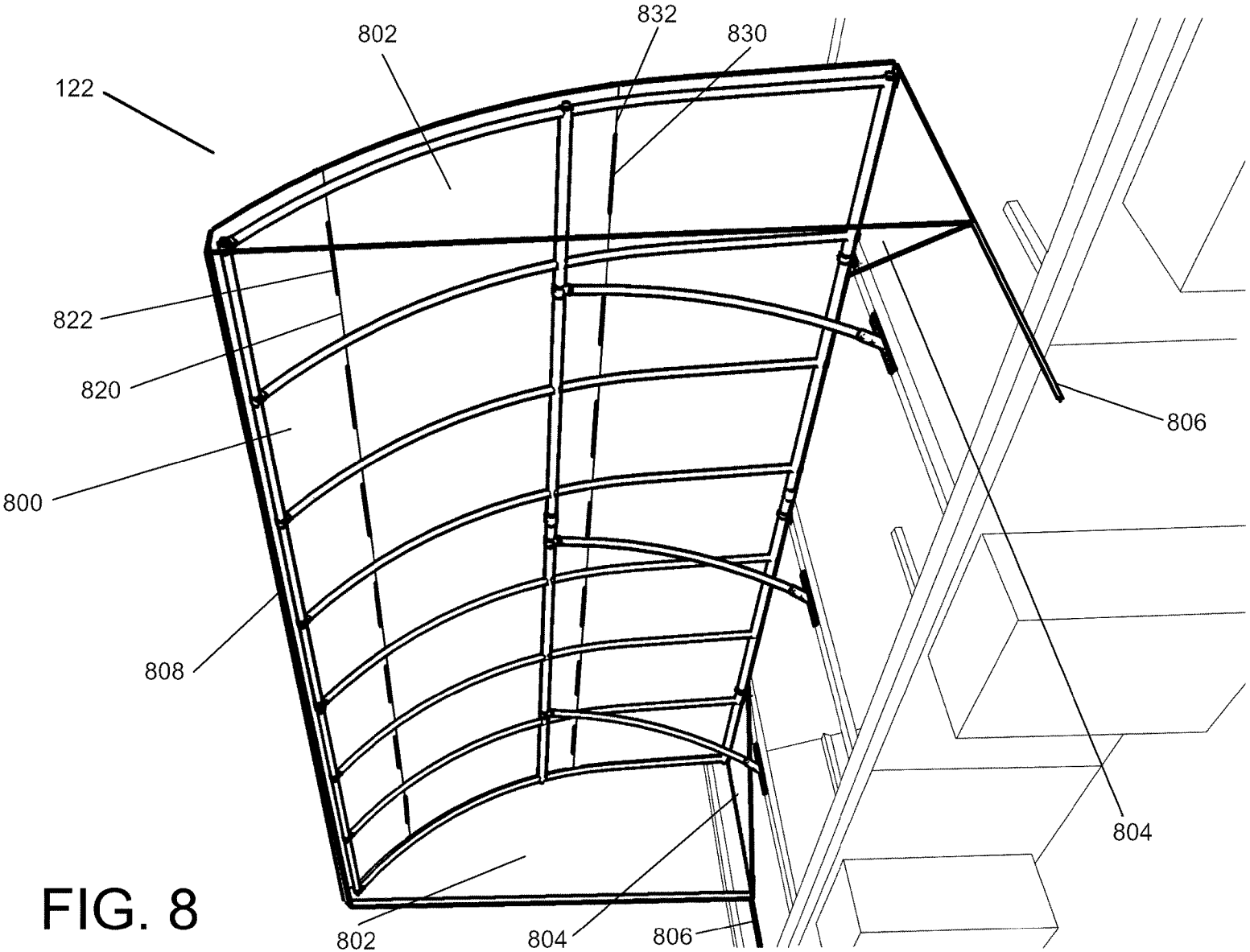
FIG. 8 is a lowered left perspective view of an embodiment, exemplary of a single cantilever member per bracket, of the invention installed on one side of a watercraft dock with a pre-existing roof covering, as viewed from the water, and with a transparent canopy cover installed on the invention.
Figure 9:
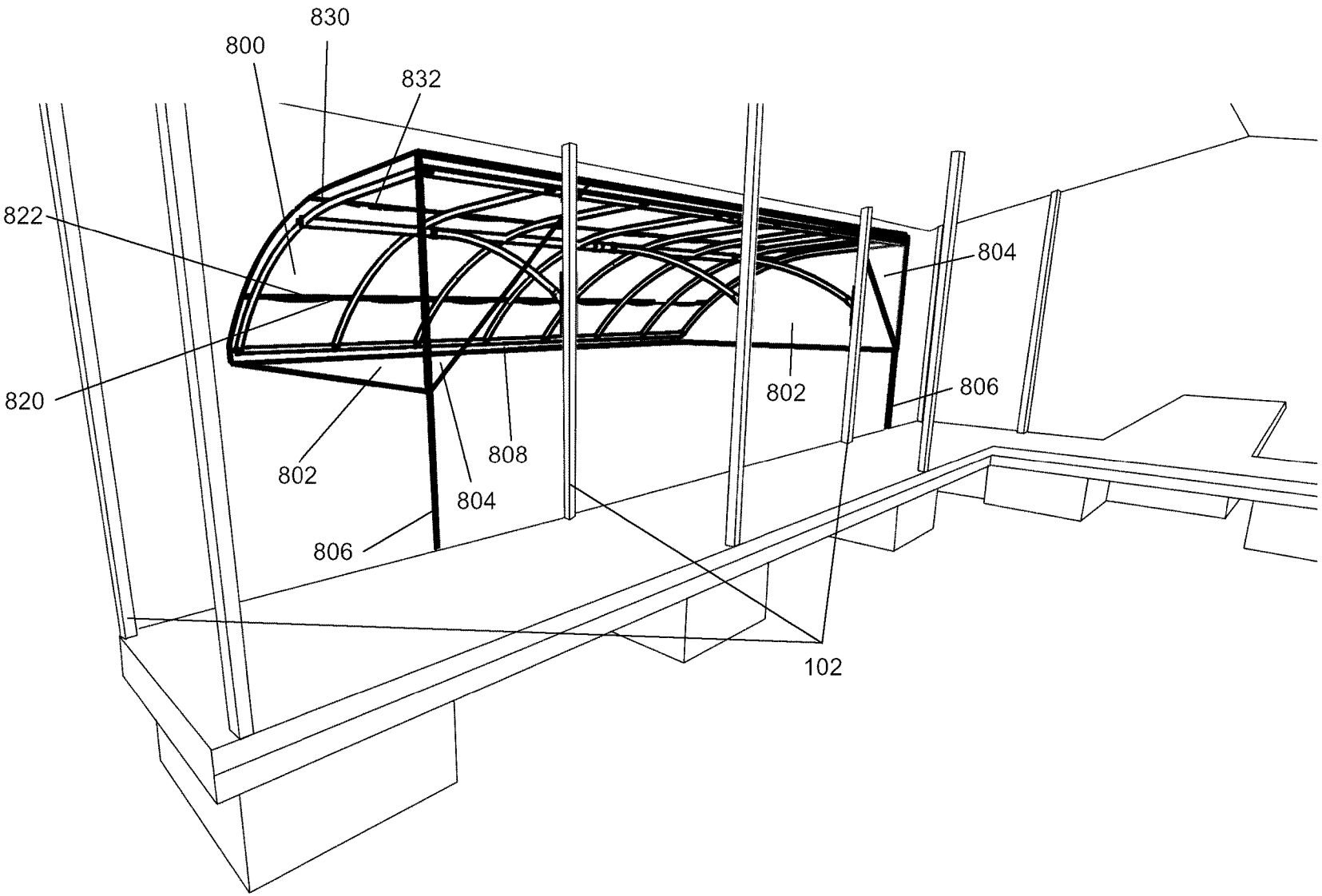
FIG. 9 is a right perspective view of an embodiment, exemplary of a single cantilever member per bracket, of the invention installed on one side of a U-shaped watercraft dock with a pre-existing roof covering, as viewed from within the central watercraft parking area of the U-shaped dock, and with a transparent canopy cover installed on the invention.

Referring now to an exemplary embodiment of the second (double cantilever support) variant depicted in FIGS. 6-7, similarly, an inner rail 600 is affixed horizontally across several of the outer vertical supports 202 via the inner rail brackets 401. Several arch members 608 are affixed at an inner end to the inner rail 600 at the inner arch joints 403. Centrally to the arch members 608 is affixed, via the central arch joints 609, a central rail 602, which is substantially horizontal and substantially parallel to the inner rail 600. At the distal terminus of the several arch members 608 is affixed, via the outer arch fittings 605, an outer rail 604. Several of the cantilever supports 221 are affixed to the vertical cantilever brackets 611, which are affixed to the outer vertical supports 202, generally vertically lower than the inner rail brackets 601. A variant cantilever bracket 611 is shown in which only a single cantilever member 221 is inserted, notably a non-right angle relative to the dock 206. Distally, the cantilever members 221 are affixed to the central rail 602 to which they are affixed via the distal cantilever brackets 607.

Referring now to the above-described embodiments of FIGS. 1-7 more generally, the vertical supports 102 or 202 are shown as the upright poles of a covered dock 100 or 200. The outer vertical supports 102 or 202 may be understood to be oriented "substantially vertical" across many embodiments. Additionally, the outer vertical supports 102 or 202 may be understood as "outer" relative to the dock 100 or 200, whose "inner" vertical supports are depicted as interior to the area covered under the roof 104 or 204. For example, the vertical supports 102 may be oriented perpendicular to the deck 106 while the entire dock 100 may have tilted in any direction relative to the surface of the water or the direction of the local force of gravity such as due to fluctuations in the water level or settling of support structures. Alternatively, the dock 100 may have become damaged such that the vertical supports 102 are not vertical either relative to deck 106, the water surface, or the direction of the local force of gravity, and yet embodiments of the invention may be practiced affixed to such a vertical support. Further, some structures may include cross-bracing or other non-vertical support structures to which embodiments of the invention may usefully be affixed, though it will be understood that the vertical supports 102 and 202 of the depicted embodiments are convenient for watercraft users to pass themselves and/or equipment through to ingress and egress from parked watercraft. Accordingly, "substantially vertical" as used herein, means to be able to transfer loads vertically, such that the inner rail 400 or 600 may be affixed thereto as well as, lower down, a cantilever bracket 411, 611, or 612. Similarly, the inner rail 400 or 600, together with the cantilever brackets 411 or 611, may be understood as aligned in a "substantially vertical plane", even if not directly above/below one another, if they are all against what an ordinary observer would intuit as the "wall" of the dock 100 or 200, made up of the plane of the vertical supports 102 or 202.

Turning now to the inner rail 400 or 600, the inner rail 400 or 600 in the depicted embodiments of FIGS. 1-7 is shown as aligned with that arm of the dock 100 or 200 that the inner rail 400 or 600 is installed against. An exemplary line 550 of a first horizontal dimension is shown in FIG. 5 and is intended to be parallel to an axial line of the aforesaid arm of the dock 100. Thus, the inner rail 400 or 600, being principally intended as aligned with or affixed against its mounting substrate, namely the dock 100, may be understood as "substantially aligned" with the first horizontal dimension if it is horizontal (relative to the deck 106 or 206, or to the water surface, or to the direction of the local force of gravity) and aligned with the dock to a tolerance that an ordinary observer walking on the deck 106 or 206 would describe it as such or, alternatively, if the inner rail 400 or 600 is effective to transfer loads horizontally between a plurality of horizontally disparate mount points on the dock 100 or 200.

In addition to the first horizontal dimension 550, the inner rail 400 or 600 may be understood to define a second horizontal dimension 551, which is perpendicular to the first horizontal dimension 550, as shown. Along the second horizontal dimension 551, "outward" may be understood to mean away from the dock 100 or 200 other mounting surface, while "inward" may be understood to mean the opposite, toward the center of the dock 100 or 200 or another mounting surface. By extension, two horizontal angles are defined as well: a first horizontal angle 552 may be understood as less than 90° and greater than 0° with respect to the first horizontal dimension 550 and second horizontal dimension 551, in a direction that is outward and toward the shore; a second horizontal angle 553 is understood as less than 90° and greater than 0° with respect to the first horizontal dimension 550 and second horizontal dimension 551, in a direction that is outward and away from the shore.

The various structural components of the invention escribed thus far, namely, the inner rail 400 or 600, the central rail 402 or 602, the outer rail 404 or 604, the arch members 408 or 608, and the cantilever supports 121 or 221 are contemplated as made of tubular steel with circular cross section, in various diameters. The various fittings for those aforesaid components, namely, the inner rail brackets 401 or 601, the inner arch joints 403 or 603, the out arch fittings 405 or 605, the distal cantilever fittings 407 or 607, the central arch joints 409 or 609, and the cantilever brackets 411, 611, or 612, are similarly contemplated as made of various steels and structured to accommodate tubing of circular cross-section retained via various set screws, friction fits, and other joining/fastening techniques, as described in further detail below. Circular cross section tubing maximally permits various sliding and rotational adjustments as further described below. Tubular metal parts are contemplated to be pierced by weepholes at regular distances to allow accumulated water (whether from condensation, rain, or other source) to drip out, leaving the interior volume to dry. Other cross-sectional shapes (e.g. square, rectangle, triangle, hexagonal) as well non-tubular (i.e., filled) configurations are contemplated as alternative embodiments. Similarly other materials than steel, such as other metal alloys, various plastic materials including PVC, as well as ceramic, composite, or wood materials are contemplated for the various structural and joint members.

Figure 15:
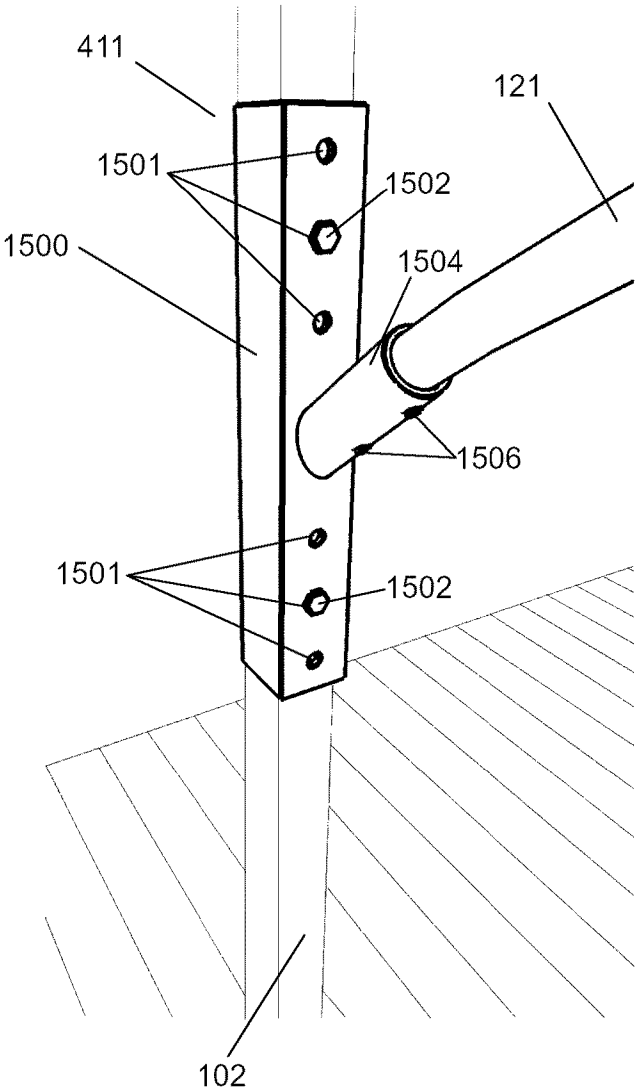
FIG. 15 is a detail perspective view of mounting hardware for a single cantilever member affixed to a vertical support, according to an embodiment of the invention.

Turning now to embodiments of the cantilever bracket 411 of the first variant, a detail view of an embodiment of the cantilever bracket 411 is shown at FIG. 15. The cantilever bracket 411 includes, in the depicted embodiment, a right-angle base 1500. The right-angle-base 1500 is provided to accommodate a rectangular outer vertical support 102 of a width that is neither known prior to installation (in which case, three-side support is feasible) nor exposed at its top (in which case, a four-sided collar is feasible). In any event, embodiments that secure the cantilever bracket 411 on two or more sides benefit from self-alignment of the bracket 411 with the outer vertical support 102 as well as additional resistance to side loads.

Referring still to the embodiment of FIG. 15, the right-angle base 1500 is pierced by several mounting holes 1501, some of which may accommodate one or more bracket fasteners 1502. The bracket fasteners are contemplated to be, for example, screws or bolts suitable to the material of the vertical supports 102. For example, in embodiments where the vertical supports 102 are made of wood, the bracket fasteners 1502 may be carriage bolts. In embodiments where the vertical supports are made of structural metal, the bracket fasteners 1502 may be machine bolts of a thread compatible with a threaded hole tapped to accommodate them. Regardless of the material of the outer vertical supports 102, the bracket fasteners 1502 may be passed through the outer vertical supports 102 and secured on the inner side thereof.

Referring still to the embodiment of FIG. 15, affixed to the right-angle brace 1500 either monolithically or by welding or other fasteners is a cantilever member receiver 1504, which is configured complementarily to the cantilever support 121 so as to receive an inner end of the tubular cantilever support 121 inside the larger-diameter tube of the cantilever member receiver 1504. The cantilever support 121 is retained in the cantilever member receiver 1504 by a pair of embedded Allen bolts 1506. Alternatives to embedded Allen bolts 1506 include set screws, lever-and-cam mechanisms, retaining pins, spring buttons, and other lock-and-release fasteners. Because the cantilever support 121 is retained in place by the embedded Allen bolts 1506, the joint depicted in FIG. 15 may be understood as "lockable". Because the cantilever support 121 is adjustable in its depth of insertion into the cantilever member receiver 1504, the joint depicted in FIG. 15 may be understood as "slidable", or "slidable-lockable", given that the embedded Allen bolts 1506 provide locking action, as previously described. Because of the round cross section of both the cantilever member receiver 1504 and the cantilever support 121, it is possible to rotate the cantilever support 121 in the cantilever member receiver 1504, and thus the join depicted in FIG. 15 may be understood as "rotatable". It will be appreciated that the right-angle brace 1500 may be mounted at different heights on the vertical support 102. The inventor has observed that the invention exhibits extensibility to different preexisting structures where the inner rail 400 is mounted first, and then the height of the right-angle brace 1500 is chosen so as to level the overall canopy. Embodiments where the central rail 402 and distal cantilever fittings 407 are of circular cross section will allow for rotation of the cantilever supports 121 about the central rail 402 to accommodate changes in the height of the right-angle brace 1500.

It will be noted that Embodiments following FIGS. 3-5 in any combination will include cantilever members supports 121 that are curved to one degree or another, and thus are asymmetrical if rotated about the inner end. Those of skill in the art will further appreciate that rotation and in-out translation will allow for additional flexibility in fitting and installing the overall structure, as deflections occur due to wind, gravity, manufacturing imprecision, etc.

Figure 16:
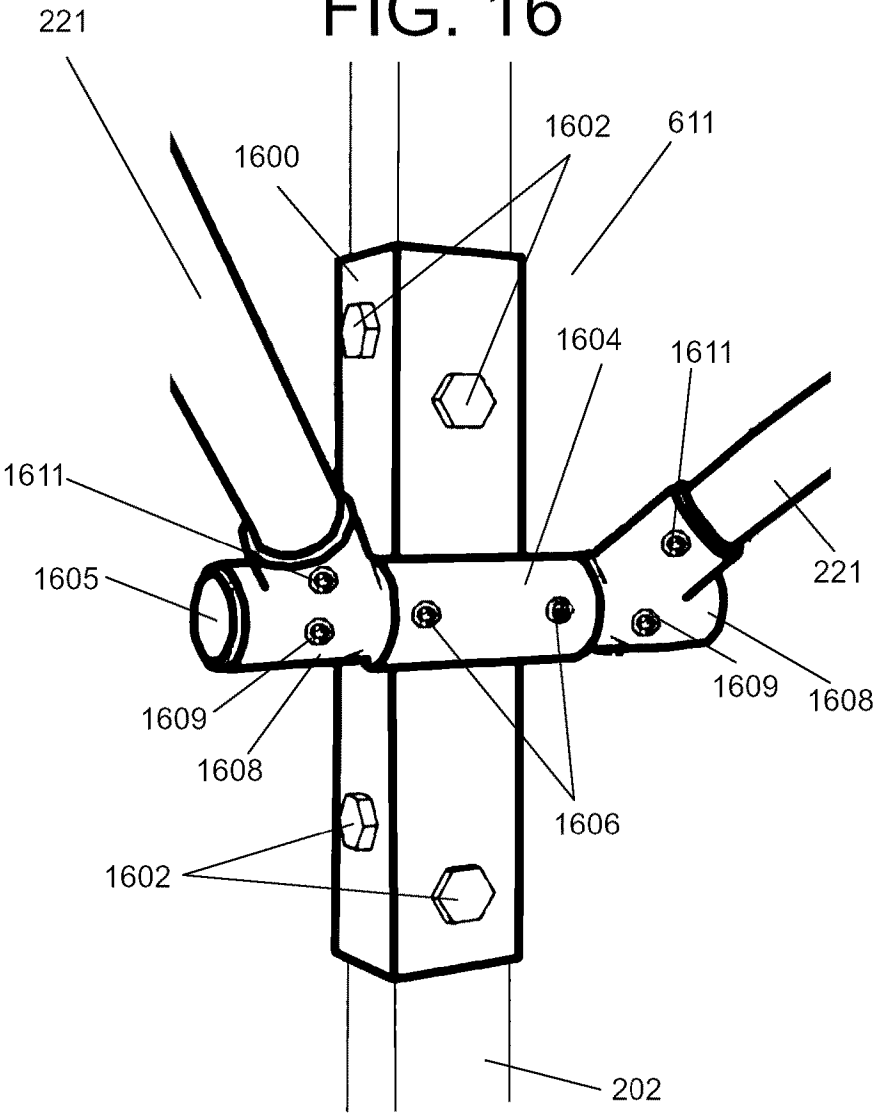
FIG. 16 is a detail perspective view of mounting hardware for two cantilever members affixed to a vertical support, according to an embodiment of the invention.

Turning now to embodiments of the cantilever bracket 611 of the second variant, a detail view of an embodiment of the cantilever bracket 611 is shown at FIG. 16. The cantilever bracket 611 includes, in the depicted embodiment, a right-angle base 1600. The right-angle-base 1600 is provided to accommodate a rectangular outer vertical support 202 of a width that is neither known prior to installation (in which case, three-side support is feasible) nor exposed at its top (in which case, a four-sided collar is feasible). In any event, embodiments that secure the cantilever bracket 611 on two or more sides benefit from self-alignment of the bracket 611 with the outer vertical support 102 as well as additional resistance to side loads.

Referring still to the embodiment of FIG. 16, the right-angle base 1600 is secured to the outer vertical support 202 by one or more bracket fasteners 1602. The bracket fasteners are contemplated to be, for example, screws or bolts suitable to the material of the vertical supports 202. For example, in embodiments where the vertical supports 202 are made of wood, the bracket fasteners 1602 may be carriage bolts. In embodiments where the vertical supports are made of structural metal, the bracket fasteners 1602 may be machine bolts of a thread compatible with a threaded hole tapped to accommodate them. Regardless of the material of the outer vertical supports 202, the bracket fasteners 1602 may be passed through the outer vertical supports 202 and secured on the inner side thereof.

Referring still to the embodiment of FIG. 16, affixed to the right-angle brace 1600 either monolithically or by welding or other fasteners is a horizontal bracket coupling 1604, which is a tube of circular cross-section in the depicted embodiment. In the depicted embodiment, at least one pivot rod 1605 is inserted into the horizontal bracket coupling 1604 and retained there via at least one to the two shown bracket fasteners 1606 (e.g., embedded Allen bolts). With reference to the last embodiment described in the Summary Of Invention, above, , the horizontal bracket coupling 1604 may be understood as a "transverse member" and the right-angle brace 1600 may be understood as a "bracket member". Surrounding the pivot rod 1605 so as to rotate with the pivot rod 1605 is one arm ofa Y-coupling 1608, referred to in the claims as a"cantilever member coupling". In the embodiment shown, the Y-coupling 1608 has a pass-through channel and a junction channel that a rigid object cannot pass through, and it is the pass-through channel that receives the pivot rod 1605, the pivot rod 1605 protruding from the Y-coupling 1608 and into the horizontal bracket coupling 1604. The junction channel ofthe Y-coupling 1608 is shown as receiving the cantilever member 221. A pass-though channel fastener 1609 (e.g. embedded Allen bolt) secures the pivot rod 1605, and a junction channel fastener 1611 (again, e.g., an embedded Allen bolt) secures the cantilever member 221.

Referring still to embodiments according to FIG. 16, variations are contemplated. FIG. 16 depicts two cantilever members 221 affixed to one cantilever bracket 611. A single-cantilever member embodiment 612, as shown in FIG. 6, may be achieved by only including one side of what is shown in FIG. 16. Further, the pivot rod 1605 may be a single rod (or a tube, generally, a cylinder) that extends through both Y-couplings 1608, or two pivot rods 1605 may be used, one for each Y-coupling 1608 and each end of the horizontal bracket coupling 1604. It will be noted that the depicted embodiment includes two fasteners that can selectively restrict rotation of the Y-coupling 1608 relative to the horizontal bracket coupling 1604, namely, the pass-through channel fastener 1609 and the bracket fastener 1606. Those of skill in the art will appreciate that rotation about the pivot rod 1605 may be achieved with only one of the two fasteners 1606 and 1609 being opened/loosened, while the other may be replaced with a rigid connection. For example, the pivot rod 1605 may be monolithically integrated with either the horizontal bracket coupling 1604 or the Y-coupling 1608.

Embodiments according to FIG. 16 include various parameters of adjustment. Each of the depicted joint fasteners 1606, 1609, and 1611, which are contemplated as embedded Allen bolts, set screws, lever-and-cam arrangements, etc., provide selective amounts of friction on the various components that they retain, and may therefore be understood as "lockable" joints between the various components so-joined. As described above, the Y-coupling 1608 may be selectively rotated relative to the horizontal bracket coupling 1604, which allows the cantilever member 221 to pivot vertically, relative to the outer vertical support 202. Accordingly, the joint between the outer vertical supports 202 and the cantilever members 221 may be understood as "pivotable". Accordingly, and with reference to the last embodiment described in the Summary of the Invention, above, the Y-coupling 1608 may be understood to comprise a "pivot receptacle" where it receives the cantilever member 221.Further, because the cantilever support 221 may be inserted into the junction channel of Y-coupling 608 to a varying amount and translated deeper or shallower therein, the joint between the cantilever support 221 and the cantilever bracket 611 may be understood as "slidable", or "slidable-lockable", given that the junction channel fastener 1611 provides locking action, as previously described. Finally, in embodiments according to FIG. 16, components for the Y-coupling 1608 are used that provide significant play in the angle that the cantilever member 221 rests in the junction channel of the Y-coupling 1608, such that the cantilever member 221 can selectively pivot in the plane relative to Y-coupling 1608 defined by its junction channel. Because the cantilever member 221 is contemplated to extend to some degree outward from the dock 200 in the second horizontal dimension 551, the angle play of the junction channel of the Y-coupling 208 allows the cantilever member 221 to pivot in a horizontal angle between the first horizontal dimension 550 and the second horizontal dimension 551.

According to the forgoing, the cantilever member 221 may be understood to be "pivotable" horizontally, as well as vertically (though, it will be noted that vertical pivot may be used as a fine adjustment compared to the course adjustment of the vertical height of the right-angle brace 1600). More specifically, the cantilever member 221 of the second variant may be understood to be affixed to the cantilever bracket 612 in a second manner in which the cantilever member is pivotable vertically (about or with the pivot rod 1605) and in a horizontal angle in either the first horizontal angle 552 or the second horizontal angle 553, both of which are greater than 0° and less than 90° with respect to the second horizontal dimension 551. Here, the first horizontal angle 551 and second horizontal angle 553 correspond to the left and right cantilever members 221 affixed to the same cantilever bracket 611, such that each of the two cantilever 221 may be understood as being approximately the other as if substantially reflected about the second horizontal dimension 551. This is in contrast to the cantilever member support 121 of the first variant, which is affixed to the cantilever bracket 411 in a first manner that allows for vertical movement of the cantilever support 121 via adjustment of the height of the right-angle brace 1500, while the cantilever support 121 is fixed, substantially aligned in the second horizontal dimension 551. One possible (i.e., sufficient, but not necessary) definition of "substantially aligned" here is that a person of skill in the art standing on the dock 100 would perceive the cantilever support 121 to extend straight out away from the dock 100.

With regard to the first and second variants of the invention, it will be understood that, in the invention's contemplated context of practice of a retrofit for an existing boathouse or canopy, it cannot be known in advance the spacing (distance between) or height of the vertical supports 102 or 202. Accordingly, the invention accounts for mixing and matching of the two variants, depending on the desired length of the canopy coverage and location of the vertical supports. The second variant allows for horizontal pivot play between the cantilever supports 221 and the vertical supports 202. The first variant allows for a cantilever support 121 to be substantially aligned with one of the vertical supports 102. By combining both variants in the same installation, it is possible to align any length of canopy to any length of preexisting boathouse and have the canopy evenly supported along its length, regardless of the spacing of the vertical supports 102 or 202, or even if the vertical supports 102 or 202 are unequally spaced. Further, both variants allow for vertical adjustment of the brackets 411 and 611, which supports leveling the overall canopy at different heights from the vertical supports 102 or 202, with an adjustable height and angle of the finished overall canopy relative to the water.

It will be further appreciated that embodiments of the invention principally cover watercraft tied to the outside perimeter of the covered dock or boathouse which generally has an inside or primary mooring area directly under the preexisting roof. However, the Inventor has observed that such open-sided structures do not adequately protect a watercraft tied in the primary mooring area from sun and precipitation that is falling from a direction other than directly up. Accordingly, many boathouse or covered dock users feel the need to cover their boats, even when tied inside the boathouse or covered dock. A secondary and not initially intended benefit of embodiments of the invention is to provide side-coverage that shelters centrally tied watercraft as well as users walking on or otherwise occupying the dock surfaces and any articles left thereon. Such benefit is present even when no watercraft are tied at the outside mooring areas directly under the canopies of embodiments of the invention.

Figure 14:
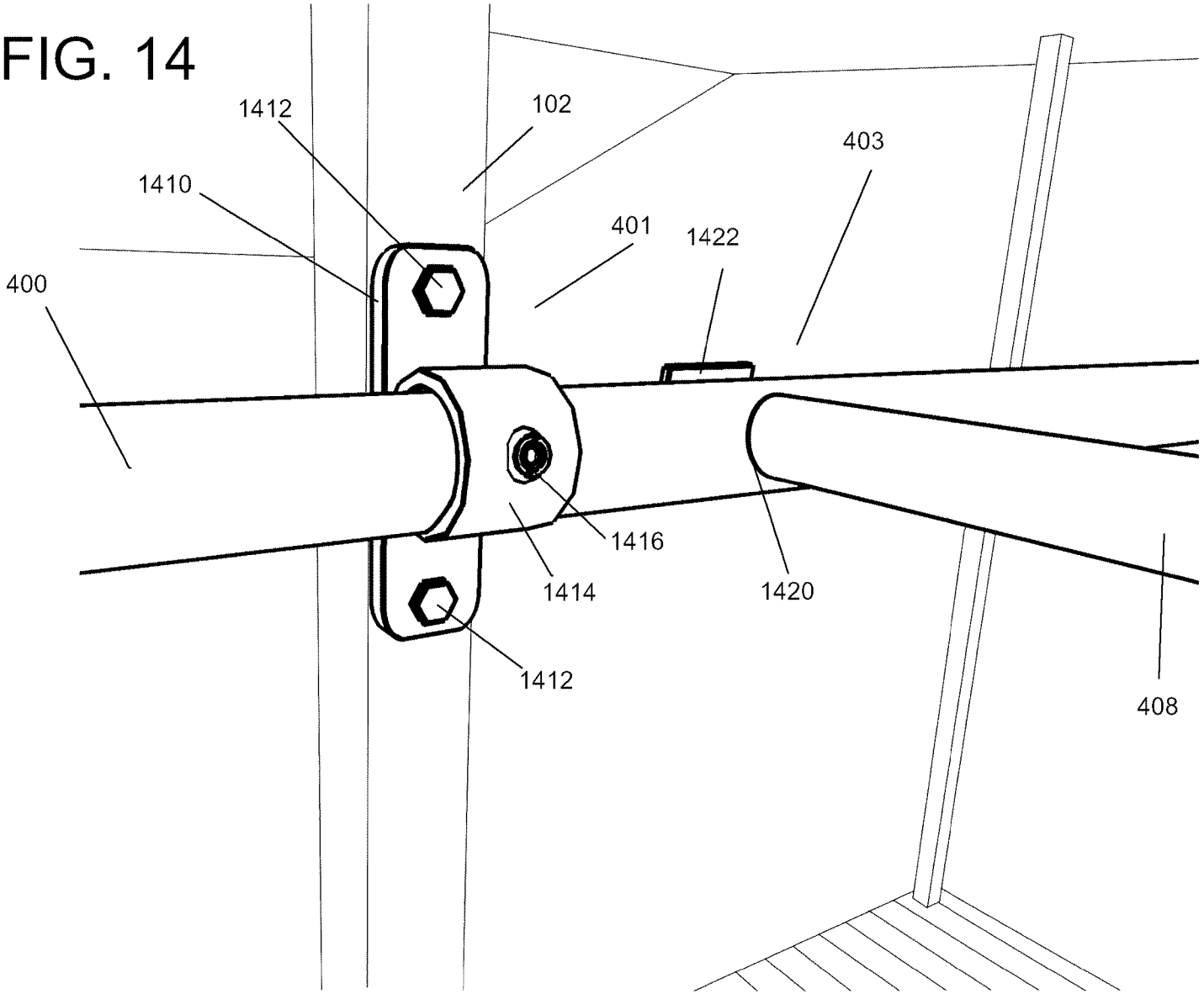
FIG. 14 is a detail perspective view of mounting hardware for an inner rail, according to an embodiment of the invention.

Referring now to FIG. 14, FIG. 14 presents a detail view of the inner rail brackets 401 and the inner arch joints 403. The inner rail 402 passes through the inner rail bracket coupling 1414, in which the inner rail 400 may rotate and where the inner rail 400 is retained there by embedded Allen bolt 1416 (which, of course may be replaced by a set screw, spring-button, lever-and-cam arrangement, etc.). The inner rail bracket coupling 1414 is a circular loop of rigid material and may, in alternative embodiments, be a different cross-sectional shape, as needed to accommodate a differently shaped inner rail 402. The inner rail bracket coupling 1414 is affixed, e.g., by welding or, monolithically, to a bracket plate 410, which is secured to the outer vertical support 102 by fasteners 1412, which may be pass-though bolts, machine bolts fitted to a tapped hole, carriage bolts, etc.

Referring still to the embodiment depicted in FIG. 14, the inner arch joint 403 is formed by an arch joint hole 1420 in the inner rail 400 that accommodates the arch member 408 to pass through the inner rail 400. Affixed to the inner end of the arch member 408 is a pull plate 1422, which may be welded or otherwise affixed to the inner end of the arch member 408. Experiments by the Inventor have shown that the arch members 408 experience significant outward tensile forces, and the Inventor has concluded that the depicted joint performs better than alternative couplings at resisting the same outward tensile forces.

Turning now to the central arch joints 409 and 609 of the embodiments depicted in FIGS. 3-7, these are achieved via a through-hole in the central rail 402 through which the arch members 408 or 608 are passed. These joints may optionally be welded or otherwise reinforced, or they may be allowed to slide freely to maintain adjustability.

Turning now to the outer ach fittings 405 and 605 as well as the distal cantilever fittings 405 and 605, the depicted embodiments of FIGS. 3-7, the fittings 405, 605, 407, and 607 are formed by off-the shelf T-junction components that receive and retain either the arch members 408 and 608 (for the outer arch fittings 405 and 605) or the cantilever members 121 and 221 (for the distal cantilever fittings 407 and 607). The contemplated fasteners for these fittings 405, 605, 407, and 607 include embedded Allen bolts, set screws, spring-buttons, and lever-and-cam arrangements.

FIGS. 8-13B show various views of embodiments of the invention with the canopy cover 122 or 222 installed. Referring now to the canopy cover 800 of the first variant, the canopy cover 122 includes a main panel 800, which lays on top of the arch members 408. Side panels 802 form the ends of the half barrel vault of the canopy of the embodiment. A narrow front panel 808 hangs down along the outside edge of the outer rail 404. To maintain a straight-down position of the side panels 802, the side panels 802 extend around the inner edge of the canopy frame 120 with inner triangle panels 804. The corner between the side panel 802 and the inner triangle panel 804 is affixed to a tension line 806, which extends down, vertically, and may be affixed to the deck 106 or other substrate, under tension, for example to a dock cleat. Exemplary materials for the canopy cover 122 include clear and opaque vinyl materials, canvas or other fabric materials, breathable mesh fabric materials, etc. Affixed to the main panel 800 may be a branding patch 1201, whereupon various trademarks may be displayed on top of the chosen material. Exemplary materials for the tension line 806 include elastic or bungee cordage, nylon or hemp rope, or metal or plastic chains, anything capable of loading under tension such that the shape of the inner triangle panel 804 and side panel 802 is maintained. In alternative embodiments, additional ribbing, for example of plastic, can provide shape to the canopy cover 122 instead of the tension line 806 and inner triangle panel 804. In alternative embodiments, the tension line 806 may be omitted and instead batons or other rigid elements may be sewn in or otherwise affixed to the interior of the side panels 802 and/or the inner triangle panel 804. In one specific example, a plastic insert baton may run along the 45° angle of the inner triangle panel 804, with a corresponding plastic insert baton inside the side panel 802, such that a right angle between the two panels is formed, as shown. In another alternative embodiment, a weighted chain or other line material may be affixed to or enclosed within the lower edge of the side panel 802; in such embodiments, the inner triangle panel 804 bay be omitted or likewise fitted with a weighted chain or line material. Such weighted chain or line material would act to apply downward tension, via gravity, to the side panel 802 and/or the inner triangle panel 804, thereby retaining their shape.

Referring still to the canopy cover 122 of FIGS. 8-13B, in the depicted embodiment, the main panel 800 includes a lower row of intermittent seams 820 punctuated by seam gaps 822, as well as an upper row of intermittent seams 830 punctuated by seam gaps 832. More generally, any number of rows of seams and seam gaps may be included in various embodiments. The seam gaps 822 and/or 832 may be sewn with more material than would be needed to close the seam, so as to hang slightly open under neutral conditions. FIG. 13A shows a cross section view of a seam 820. The lower panel 1301 terminates in a fold 1302, which is tightly closed and affixed to the upper panel 1303 via stitching 305, underneath the upper panel overhang region 1304. These structures are translated axially in the fabric to the seam gaps 822, as shown in the cross-sectional view of FIG. 13B. Here, the stitching 1305 is absent so that the overhang region 1304 is free to flap as urged by an airflow 1370, relieving strain on the overall structure of the invention in high winds. In the event of rain being pushed up the canopy cover 122 by the airflow 1370, the unstitched fold 1302 collects a quantity of water 1360 and prevents the water 1360 from leaking into the area under the canopy cover 122. In alternative embodiments, the unstitched fold 1302 may be omitted in favor of a stitched fold or no fold; this is desirable generally where the embodiment requires comparatively greater permissiveness of airflow and the cost of marginally reduced protection against water inflow.

Figure 10:
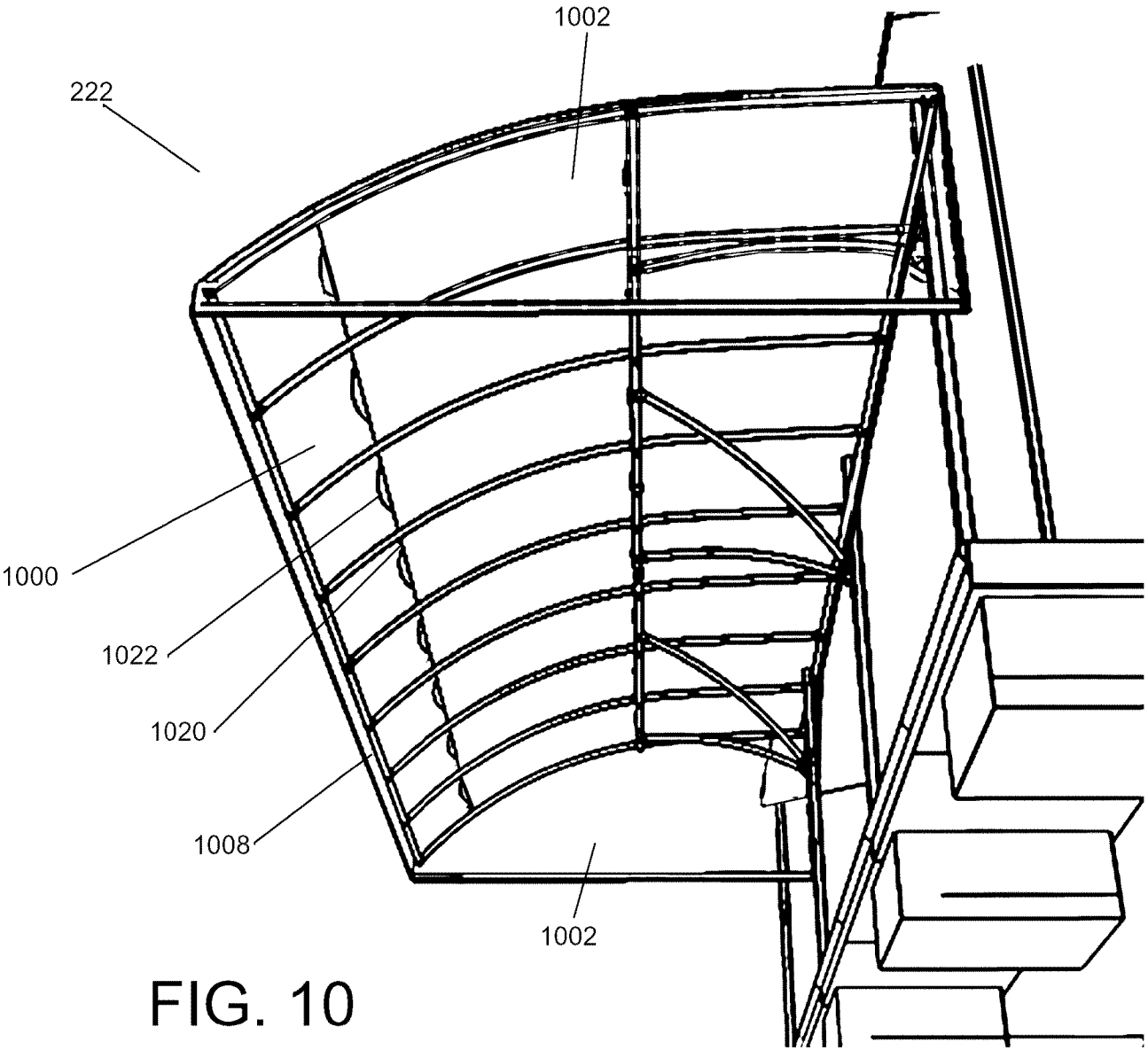
FIG. 10 is a lowered left perspective view of an embodiment, exemplary of two single cantilever members per bracket, of the invention installed on one side of a watercraft dock with a pre-existing roof covering, as viewed from the water, and with a transparent canopy cover installed on the invention.
Figure 11:
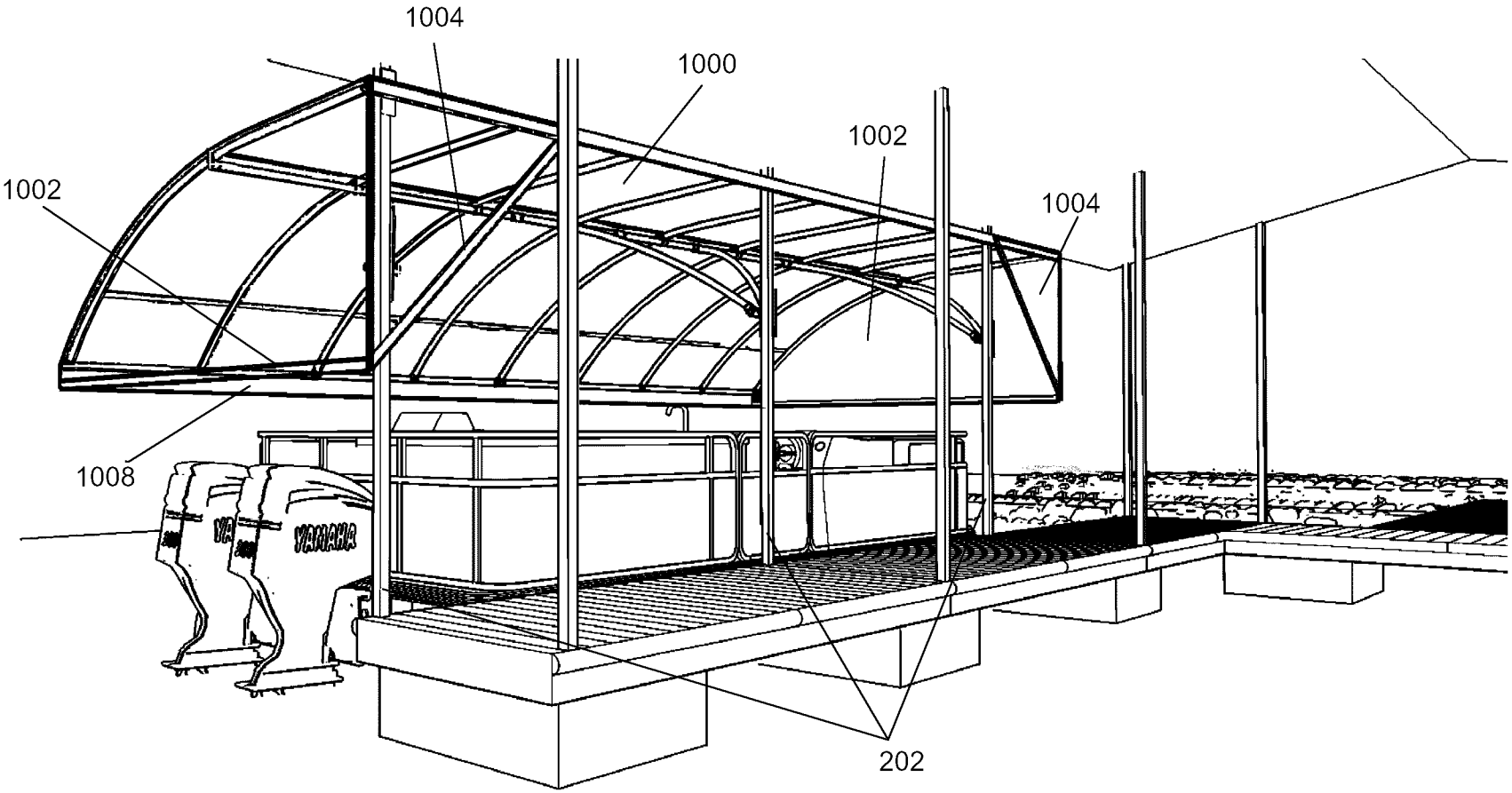
FIG. 11 is a right perspective view of an embodiment, exemplary of a single cantilever member per bracket, of the invention installed on one side of a U-shaped watercraft dock with a pre-existing roof covering, as viewed from within the central watercraft parking area of the U-shaped dock, and with a transparent canopy cover installed on the invention.
Figure 12:
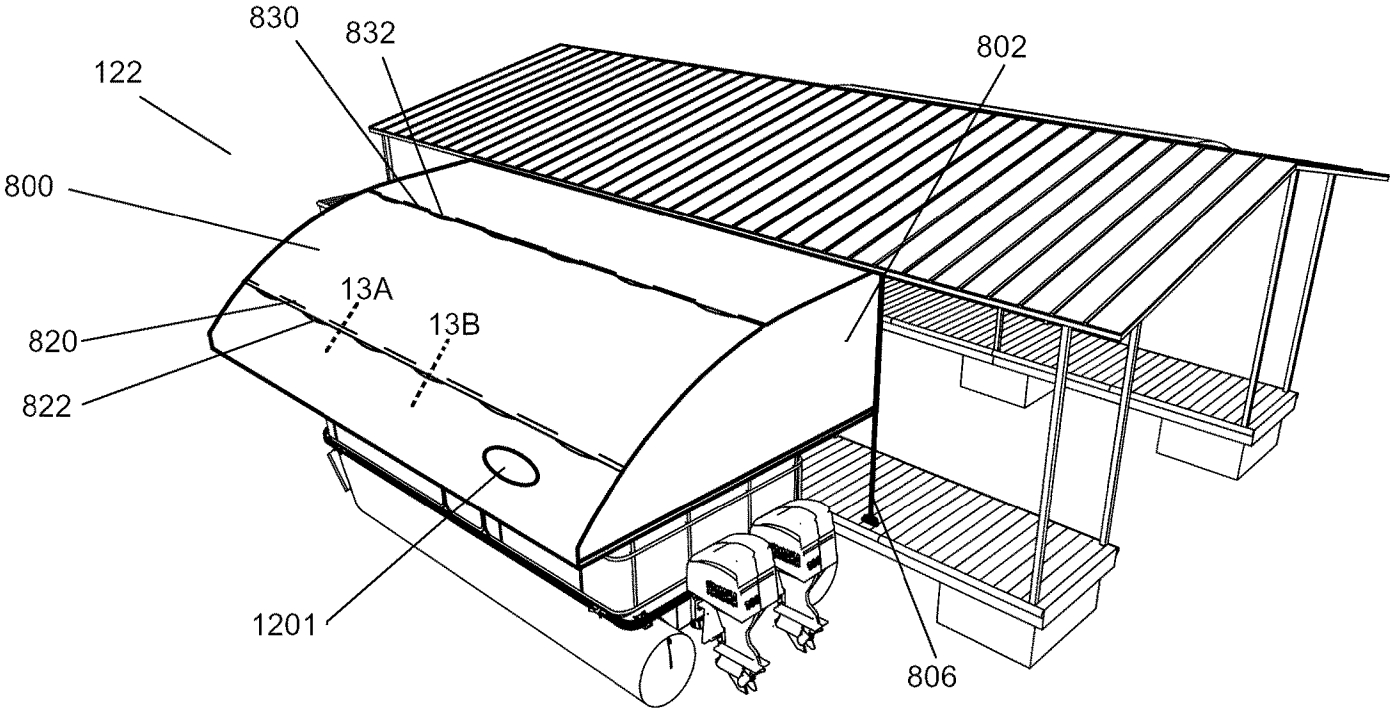
FIG. 12 is an elevated left perspective view of an embodiment of the invention installed on one side of a watercraft dock with a pre-existing roof covering, as viewed from the water, and with an opaque canopy cover installed on the invention.
Figure 13B:
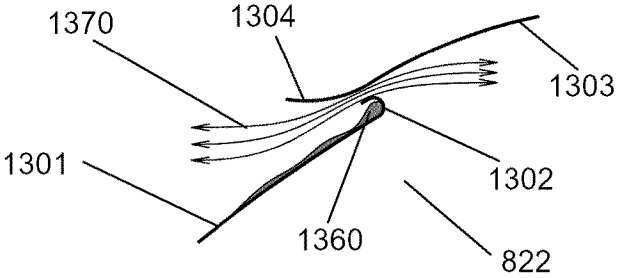
FIG. 13B is a sectional view of a seam gap in a canopy cover of an embodiment of the invention.
Figure 13A:
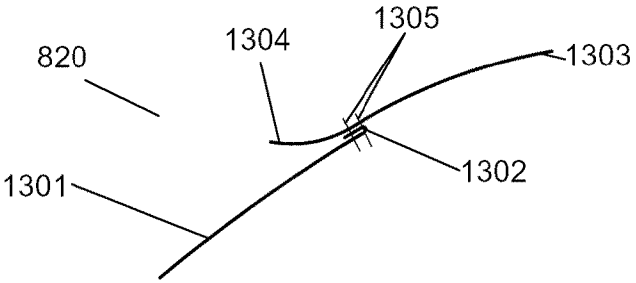
FIG. 13A is a sectional view of a seam in a canopy cover of an embodiment of the invention.

FIGS. 10-11 show the canopy cover 222 of the second variant. In the embodiment depicted in FIGS. 10-11, the canopy cover 222 includes a main panel 1000, which lays on top of the arch members 608. Side panels 1002 form the ends of the half barrel vault of the canopy of the embodiment. A narrow front panel 1008 hangs down along the outside edge of the outer rail 604. A single row of seams 1020 punctuated by seam gaps 1020 crosses the main panel 1000, though any number of rows of seams and seam gaps are contemplated. Generally, all components of the canopy cover 222 of the second variant follow those described above for the first variant.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A structure comprising:

at least one substantially vertical support;

an inner rail substantially aligned in a first horizontal dimension, affixed to said at least one vertical support, and defining a second horizontal dimension perpendicular to said first horizontal dimension;

at least one bracket affixed to said at least one vertical support, vertically lower than said inner rail and aligned in a substantially vertical plane;

at least one cantilever support affixed slidably-lockably to said at least one bracket, wherein said at least one cantilever support is affixed to said bracket in a manner selected from the group consisting of: (a) a first manner such that said cantilever support is rigidly fixed and substantially aligned in said second horizontal dimension, and (b) a second manner such that said cantilever support is pivotable vertically and pivotable in a horizontal angle with respect to said second horizontal dimension that is greater than zero degrees and less than ninety degrees;

a central rail substantially aligned in said first horizontal dimension substantially parallel to said inner rail, positioned distally from said inner rail in said second horizontal dimension, and affixed to said at least one cantilever support; and at least one arch member substantially aligned in said second horizontal dimension and affixed to said inner rail and said central rail.

2. The structure of claim 1, further comprising an outer rail substantially aligned in said first horizontal dimension substantially parallel to said inner rail and said central rail, positioned distally from said central rail in said second horizontal dimension, and affixed to said at least one arch member.

3. The structure of claim 1, wherein at least a first of said at least one cantilever support is supported in said second manner and a second of said at least one cantilever support is affixed in said second manner to the same of said at least one bracket as said first of said at least one cantilever support such that said horizontal angle of said second of said at least one cantilever support is substantially reflected about said second horizontal dimension from said horizontal angle of said first of said at least one cantilever support.

4. The structure of claim 1, wherein:

at least one of said at least one cantilever supports is affixed to said at least one bracket in said second manner;

said bracket comprises a horizontal bracket coupling affixed to a right-angle brace, said right-angle brace being affixed to said at least one vertical support;

a pivot rod is inserted into said horizontal bracket coupling and rotatably-lockably retained therein;

said pivot rod being affixed to a cantilever support coupling such that said coupling rotates with said pivot rod relative to said horizontal bracket coupling;

said at least one cantilever support is affixed, at least pivotably in a manner that forms said horizontal angle, to a junction channel of said cantilever support coupling.

5. The structure of claim 1, wherein said at least one vertical support is preexistingly affixed, at its vertical bottom end, to a substantially horizontal platform and preexistingly affixed, at its vertical top end, to a roof.

6. The structure of claim 1, wherein said at least one vertical support is a vertical post of a covered marine dock, said first horizontal dimension is substantially aligned with an outside edge of said covered marine dock, and said at least one arch member extends out from said covered marine dock over an area of water.

7. The structure of claim 1, wherein a first of said at least one cantilever support is affixed to a first of said at least one bracket in said first manner and at least a second of said at least one cantilever support is affixed to a second of said at least one bracket in said second manner.

8. The structure of claim 1, further comprising:

a canopy cover;

said canopy cover being stretched over said at least one arch member.

9. The structure of claim 8, wherein said canopy cover hangs vertically downward from an outside one of said at least one arch member to form a half barrel vault cover.

10. The structure of claim 9 wherein said half barrel vault cover is made of a mesh material that allows fluids to pass through.

11. The structure of claim 8, wherein:

said canopy cover comprises a seam substantially oriented in said second horizontal dimension;

said seam comprises a canopy cover upper sheet overhanging a canopy cover lower sheet;

said seam comprising at least one stitched region wherein said canopy cover lower part is stitched to said canopy cover upper part and at least one unstitched region wherein said canopy cover lower part hangs freely.

12. The structure of claim 11, wherein said canopy cover lower part is overfolded upward in said at least one stitched region so as to create an outwardly concave catchment in said at least one unstitched region.

13. The structure of claim 11, wherein said half barrel vault cover is configured to retain its shape under tension.

14. The structure of claim 11, wherein said half barrel vault cover is secured taught by a length of canopy cordage affixed both to said half barrel vault cover and a substrate, said at least one vertical support being affixed to said substrate.

15. A structure, comprising:

a canopy frame supporting a canopy cover affixed thereto;

said canopy cover comprising a seam oriented substantially horizontally;

said seam comprises a canopy cover upper sheet overhanging a canopy cover lower sheet;

said seam comprising at least one stitched region wherein said canopy cover lower part is stitched to said canopy cover upper part and at least one unstitched region wherein said canopy cover lower part hangs freely; and said canopy cover lower part is overfolded upward in said at least one stitched region so as to create an outwardly concave catchment in said at least one unstitched region.

16. The structure of claim 15, wherein said canopy cover hangs vertically downward from an outside end of said canopy frame to form an end cover.

* * * * *